United States Patent [19]

Frye

[11] 4,239,141

[45] Dec. 16, 1980

[54] WEB SPREADER

[75] Inventor: Kenneth G. Frye, Lee, Mass.

[73] Assignee: Lenox Machine Company, Inc., Lenox, Mass.

[21] Appl. No.: 963,014

[22] Filed: Nov. 22, 1978

Related U.S. Application Data

[63] Continuation of Ser. No. 810,576, Jun. 27, 1977, abandoned.

[51] Int. Cl.[3] ..... B65H 17/32

[52] U.S. Cl. ..... 226/7; 226/197

[58] Field of Search ..... 226/196, 197, 199, 7, 226/97; 26/101; 242/56.5

[56] References Cited

U.S. PATENT DOCUMENTS

| | | | |
|---|---|---|---|
| 3,106,365 | 10/1963 | Karr | 226/199 X |
| 3,171,579 | 3/1965 | Robertson | 26/101 X |
| 3,248,031 | 4/1966 | Kilmartin | 226/194 |
| 3,438,100 | 4/1969 | Moore | 26/101 |
| 3,452,913 | 7/1969 | Evans | 226/199 X |
| 3,463,377 | 8/1969 | Lucas | 226/199 X |
| 3,765,616 | 10/1973 | Hutzenlaub | 226/199 X |
| 3,940,043 | 2/1976 | Staples | 226/199 X |

*Primary Examiner*—Richard A. Schacher

*Attorney, Agent, or Firm*—Hill, Van Santen, Steadman, Chiara & Simpson

[57] ABSTRACT

A web spreader which has great versatility for adjustment to fit virtually any spreading requirement and capable of spreading webs uniformly regardless of the number of slits and adapted to be adjusted for gauge variations. A pair of spreader bars has the just slit strips of a web trained thereover in successive partial wrap wherein one of the bars may have an adjusted bow therein and the other of the bars has a capability for both a bow adjusted condition and means for incrementally adjusting its web strip wrap area to compensate for web variation.

29 Claims, No Drawings

WEB SPREADER

This is a continuation of application Ser. No. 810,576, filed June 27, 1977 now abandoned.

This invention relates to web spreaders, and is particularly concerned with improving the versatility of such spreaders.

In the production of sheet material, such as paper, large machines are often used to produce the sheet product. In view of the large size of the machinery, the sheet is frequently quite large and very often too large to be utilized directly. For example, in the manufacture of paper, it is not unusual to produce paper in the form of a roll having a width of 30 feet and a diameter of 9 feet. Paper rolls of this size are not normally directly useable. For example, in the case of newsprint, the rolls used by the printer are much smaller both in width and in diameter.

While in the foregoing paragraph and hereinafter, reference may be made to paper, it is to be understood that while the invention has particular suitability in the manufacture of paper, it has general applicability to any sheet material.

In order to reduce the size of the paper roll, the large roll is usually rewound onto a plurality of axially aligned cores of suitable length on a rewind device. As the paper is wound from the large roll onto the cores, the paper is slit lengthwise to form a plurality of webs of proper width. The width corresponds to the length of the core on which the particular sheet is wound. Overlap of paper between adjacent rolls on the rewinding device obviously cannot be tolerated and, for this reason, the slit paper is spread out by means of one or more spreader rolls or bars.

By way of example of prior spreaders, U.S. Pat. No. 3,645,433 is referred to as representative of the so-called fan type wherein a web slit into multiple widths or strips has the strips diverted generally fan-shape. For at least certain conditions, number of slits, paper grade, etc., such a spreader is not suitable, or for other reasons it is preferred to have the web strips return to parallel running relation with the original web. For this purpose a two bar arrangement such as disclosed in U.S. Pat. No. 3,463,377 is of particular value. In the latter form of spreader the web strips are fanned-out a limited amount in travelling over the first spreader bar and then in running over the second spreader bar are returned to a parallel running direction while increasing slightly the spaced relationship between adjacent web strips.

A problem with the two bar spreaders has been that where significant web thickness, bulk or length variations are encountered there has been a tendency for the slit strips to interweave or corrugate due to localized uneven tension resulting from the thickness, bulk or length variations.

It is therefore an important object of the present invention to overcome the problem of web thickness, bulk, length (baggy area) variations in the operation of a two bar web spreader.

Another object of the invention is to provide a new and improved method of and means for adjusting a web spreader to compensate for variations in web thickness, length or bulk.

A further object of the invention is to provide a new and improved two bar web spreader in which web strips are run across a first variably adjustable bowed spreader bar and then over a second adjustable bowed spreader bar which is also incrementally adjustable along its length to compensate for web thickness, bulk or length variations.

According to features of the invention there is provided a web spreader adapted to be operatively disposed between a slitter and other processing equipment such as a winder, sheeter and the like, and comprising a first spreader bar adapted to have web strips run across a limited wrap area thereof, said first spreader bar having a bowed relation to the web strips to spread them substantially fan-shape, a second spreader bar mounted adjacently downstream from the first bar and adapted to receive the web strips to run across a web strip area of the second bar, said second bar having a primary bowed relation to the web strips for orienting the strips from the fan spread relation effected by said first bar into substantially parallel running relation, and means for selectively effecting secondary adjustments of the web strip wrap area of the second bar incrementally along its length without altering said primary bowed relation whereby to compensate for variations in web thickness, bulk or length.

According to other features of the invention there is provided a method of operating a two bar spreader wherein each of the bars has a respective limited wrap area longitudinally therealong and across which web strips running between a slitter and other processing equipment such as a winder, sheeter, etc., travel in passing through the spreader, and comprising, providing one of said spreader bars with a bowed relation to the web strips effecting spreading of the web strips substantially fan-shape in travelling across the limited wrap area of said one spreader bar, providing a primary bowed relation of the other of said spreader bars to the web strips effecting orientation of the strips from the fan spread relation into substantially parallel running relation in travelling across the limited wrap area of said other bar, and selectively effecting secondary adjustments of the web strip wrap area of said other bar incrementally along its length without altering said primary bowed relation; and thereby compensating for variations in web thickness, bulk or length.

For some operations, only one of the spreader bars may suffice to guide the strips in laterally spaced relation over the wrap area of the bar, such bar being provided with a primary bowed relation, and means for selectively effecting secondary adjustments of the web strip wrap area incrementally along its length without altering the primary bowed relation, and thereby compensating for variations in web thickness, bulk or length.

Other objects, features and advantages of the invention will be readily apparent from the following description of a representative embodiment thereof, taken in conjunction with the accompanying drawings although variations and modifications may be effected without departing from the spirit and scope of the novel concepts embodied in the disclosure and in which:

FIG. 1 is a schematic vertical sectional view showing a web spreader embodying features of the invention.

FIG. 4 is a sectional, detail view taken substantially along the line IV—IV of FIG. 2.

Figure 2:
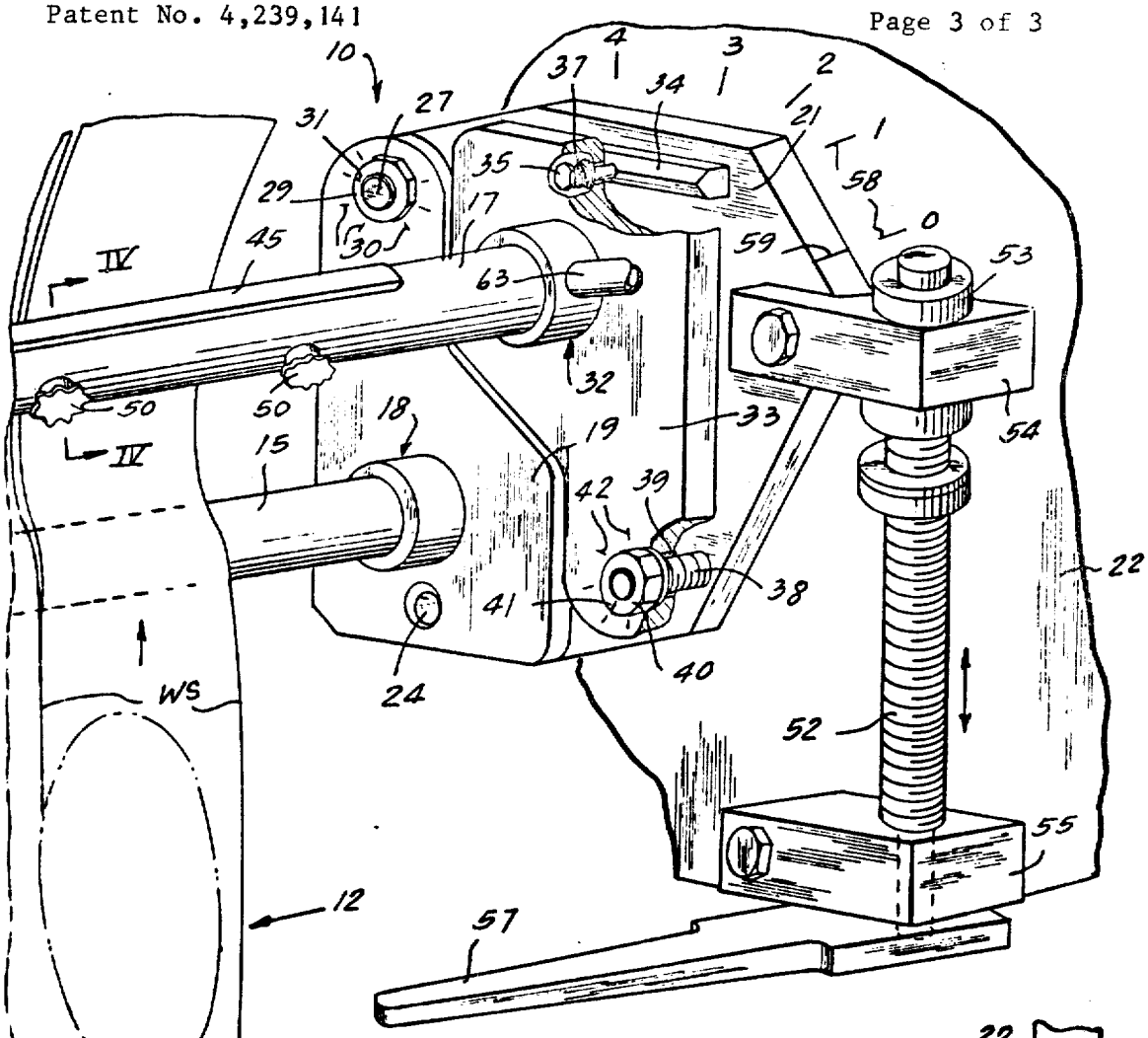
FIG. 2 is an isometric view showing a portion of the spreader.

Referring to FIG. 1, a web spreader 10 embodying features of the invention is depicted in a desirable operating orientation in an unwinder slitter winder mechanism of the type known as a front drum wrap winder, although it will be appreciated that the device may be applied to other equipment such as the type known as a back drum wrap winder, sheeters, or other processing equipment. In the illustrated instance, a web W to be slit is advanced from source such as a roll or papermaking machine and runs over a before-slitter roll 11 and then through a slitter 12 of suitable form such as the disk type. Beyond the slitter, web strips WS pass through the spreader 10 wherein the strips are spread apart laterally. Beyond the spreader 10 the individual spread apart strips are wound upon respective cores 13 into rolls between drums 14.

In passing through the spreader 10, the continuously running web strips WS pass in generally zig-zag relation in partially wrapping relation first across a bowed spreader bar 15 and then across a bowed spreader bar 17. By having the first bar 15 bowed in generally a direction, opposite that of the web travel, and the strips WS partially wrapping the convexly bowed side of the bar the strips are separated in generally fan shape to the extent controlled by the radius of curvature of the bow. Then, by having the second spreader bar 17 bowed in generally a direction opposite that of the web travel, and the strips WS partially wrapping the inside or concave bow of the bar 17 the strips are straightened in their longitudinal running direction so as to be in substantially parallel side-by-side spaced relation.

Figure 3:
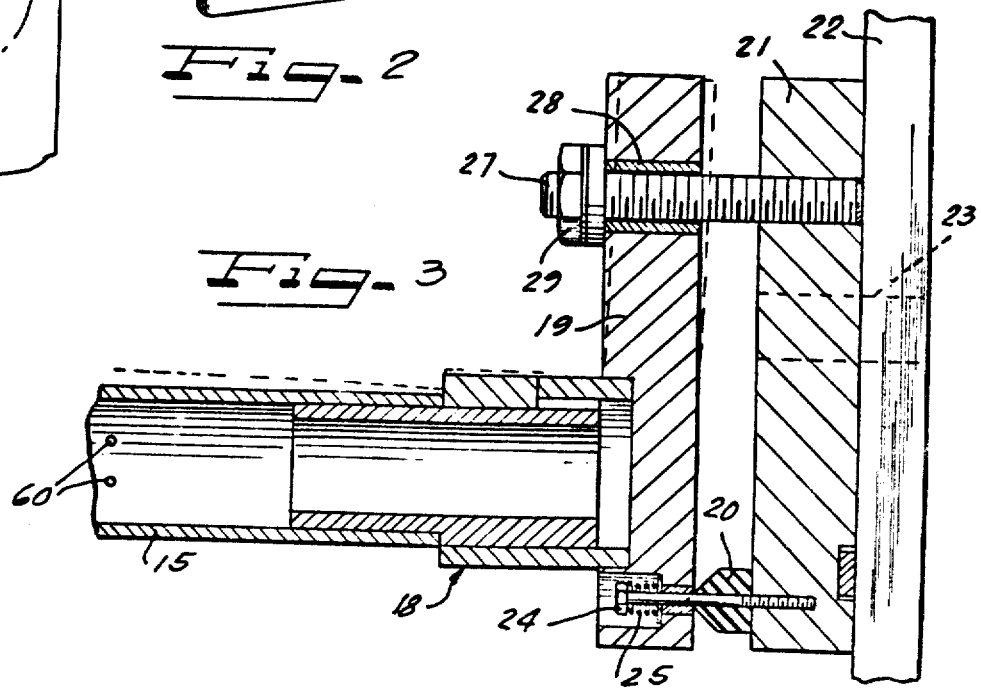
FIG. 3 is an enlarged sectional detail view taken substantially along the line III—III of FIG. 1.

Although any means may be used to adjust the bow in the bars, in a preferred construction, the spreader bar 15 comprises a resiliently bendable tube having its opposite ends mounted on bending couplings 18 carried by respective bow generating lever plates (FIGS. 1, 2 and 3). Adjacent to the couplings 18, each of the bow generating plates 19 is pivotally engaged upon an elongated fulcrum strip 20 carried by an end plate 21 mounted on a supporting frame 22 by means of trunnion 23. The plate 19 is held to the fulcrum strip 20 by suitable means comprising an assembly of a bolt 24 and a spring 25. For bowing the tubular spreader bar 15, the bow generating plates 19 are caused to rock about the fulcrum strips 20 toward the mounting plates 21 by means conveniently comprising in each instance a bolt 27 spaced from the bow couplings 18 a substantially greater leverage distance than the couplings are spaced from the fulcrum 20. The bolts 27 are fixedly attached to the respective end plates 21 and extend through clearance bushings 28 in the plates 19. By drawing up on adjustment nuts 29 on the exposed end portions of the bolts 27, the plates 19 are rocked forcefully the desired distance toward the end plates 21 as represented in dot-dash outline in FIG. 3, and the spreader bar 15 is correspondingly bowed, as shown, to the desired bow radius which is adapted to be adjusted to provide optimum web strip spreading results in operation. In order to standardize the bow adjusting capability of the mechanism, the outer face of the plate 19 is adapted to be provided with calibration indicia 30 with which a suitable indicia 31 on the nut 29 is adapted to be registered to attain any preferred selected bow radius in the spreader bar 15 and to coordinate adjustments of the bow generator plates 19 at opposite sides of the device.

To the same general effect, the spreader bar 17 comprises a resiliently bendable tube (FIGS. 2 and 4) attached at its opposite ends by means of respective bending couplings 32 secured fixedly to a bow generating plate 33 mounted to rock upon an elongated fulcrum strip 34 carried by the end plate 21. Rocking attachment of the plate 33 to the fulcrum strip 34 is by means of a bolt 35 and a yieldable spring 37. Bow generating rocking of the plate 33 is adapted to be effected by means of a bolt 38 secured to the mounting end plate 21 at a point spaced substantially further from the coupling 32 than the fulcrum strip 34. The bolt 38 extends through a bushing 39 in the plate 33 so that by tightening up on a nut 40, the plate 33 will be rocked toward the mounting plate 21 for bowing the spreader bar 17 in generally a direction opposite that of web travel. For calibration purposes, an indicia mark 41 on the nut 40 may be aligned with any selected bow indicating indicia mark 42 adjacent to the bolt nut 40 on the outer face of the plate 33.

Although a primary bow of suitable radius in the spreader bar 17 relative to the adjusted bow radius fixed for the spreader bar 15 may provide satisfactory web spreading results where the web W is of substantially uniform gauge or thickness, bulk and length, the spreader bar 17 is equipped to effect incremental secondary adjustments along its length in the web strip wrap area to compensate for situations where irregularities occur in web thickness, bulk or length. To this end, means are provided which are relatively accessible while the spreader 10 is in web strip separating operation to effect the desirable incremental wrap area secondary adjustments without altering said primary bowed relation. In a desirable construction, such means comprise substantially rectangular blocks 43 inside the tubular bar 17 and projecting therefrom through rectangular slots 44 extending on increments along the length of the tube 17 short of the opposite ends of the tube. Along their outer edges, the blocks 43 are rigidly attached to a saddle bar adapter 45 of a width and transverse curvature to engage complementally with the approximately 45° or less wrap area of the spreader bar 17 across which the strips WS run in operation. Respective control screws 47 are threaded into the blocks 43 and shank portions of screws 47 extend through suitable apertures in the bar 17 about which are secured thrust seats 48 against which respective hubs 49 of manually engageable adjustment knob wheels 50 are in thrusting engagement. Means such as respective pins 51 secure the adjustment wheel hubs 49 fixedly to the shanks of the associated adjusting screws 47. By means of the engagement of the blocks 43 by the edges of the spreader bar 17 at the rectangular slots 44, the saddle bar is caused to normally assume substantially the bowing radius of curvature of the spreader bar 17.

As will be observed, the saddle bar 45, which provides the limited surface are of the spreader bar 17 wrapped by the web strips WS, is at one side of the bar 17 and only partially within the surface area of the bar 17 which has the curvature under bow stress. By having the blocks 43 located at suitable incremental intervals along the length of the bar 17, such that the adjusting screws 47 are spaced in a typical instance of about 6 inch intervals, selected limited area tension compensating adjustments can be readily effected by manipulation of the adjustment wheels 50. By turning any selected one of the adjustment wheels 50 in the loosening direction of the associated screw 47, the tension to which the saddle bar 45 is subjected in the bowed adjustment of the bar 17 causes the saddle bar 45 to pull away from the bar 17 at the limited area of adjusted relaxation, substantially as indicated in dash outline in FIG. 4. As a result, fine selective adjustments can be effected throughout the length of the spreader bar 17 to compensate for any detected web thickness, bulk or length variation where any of these conditions may appear in any of the web strips while the web spreader is in operation.

In order to effect changes in wrap of the two bars 15 and 17, means are provided for turning the mounting plates 21 about the trunnions 23. Suitable means for this purpose comprise an adjustment screw 52 (FIGS. 1 and 2) attached to each of the plates 21 through a coupling 53 mounted in a connecting block 54 fixed on the associated plate. At its opposite end the adjustment screw 52 extends threadedly through a block 55 fixed to the frame 22. Through this arrangement, by manipulating a handle 57 fixed to the end of the screw 52 which extends through the block 55, turning of the associated mounting plate 21 can be effected to adjust the spreader bars 15 and 17 relative to the path of the web strips across and between the bars for either adjusting the wrap of the web strips or for moving one or both of the bars entirely out of engagement with the web strips if desired.

To facilitate coordinated adjustment of each of the mounting plates 21 gauging scale means may be provided comprising indicia identified generally radiating spaced marks 58 on the frame 22 adjacent the upper edge of the respective plate 21 as seen in FIG. 2 and with which a gauge mark 59 on edge of the plate 21 is adapted to be registered selectively to determine a number of selective adjusted positions of the spreader bars 15 and 17 relative to the web travel path between the bars.

Where air flotation support support of the web strips WS on the limited web strip spreading control wrap surface of the bar is desired, air under pressure may be supplied to such wrap surfaces through perforations in the wrap surfaces. For example, the adjustable bow spreader bar 15 may be provided with such perforations 60 (FIG. 3). For a discussion of the effect and benefit of such air flotation reference may be made to U.S. Pat. No. 3,463,377.

Air flotation capability for the spreader bar 17 presents a different situation because the saddle bar 45 (FIG. 4) is necessarily separable relative to the body of the hollow bar 17. Therefore to provide for air flotation lubrication of the web strips, the auxiliary bar 43 has an air channel 61 longitudinally therein from which ports 62 deliver air to the surface of the saddle bar 45 across which the web strips SW ride in operation. Air under pressure from any suitable source such as an air compressor of compressed air tank may be delivered to the channel 61 in any suitable manner, such as through a supply duct 63 (FIG. 2).

In operation of the web spreader 10 each of the spreader bars 15 and 17 is initially adjusted to the required bow for the web material to be handled, by means of the bow adjusting plates 19 and 33, respectively, at each opposite end of each of the bars. Before or after such bow adjustment of the bars, the bar assembly is adjusted to attain the desired degree of wrap of the web strips WS across the bars. Typically such wrap may be up to 45° of the circular bar peripheries, although for different types of webs, it may be desirable to effect corresponding adjustments in the degree of wrap in accordance with field experience. After bar adjustments have been made, the web strips WS are threaded onto and between the bars and onto the wind-up cores, as one example, or into or through other processing equipment. The rewinding or other processing is then started and run at thread speed to determine if the slit separation is uniform all the way across the run. If the separation spacing is not satisfactory to begin with, the bow of either or both of the spreader bars can be readily adjusted while the slitting and rewinding continues, at production speed or at a slower than production speed, if desired, because the adjustment bolt nuts 29 and 40 are readily accessible. Then, if at some localized areas tension appears to be ununiform such as may be indicated by a baggy condition in respect to any one or more of the web strips WS, adjustment can be quickly effected by manipulation of the adjustment handle wheel 50 at the indicated point along the spreader bar 17 whereby to attain compensating adjustment in the affected local area of the saddle bar 45. When all of the web strips WS appear to be running correctly for proper rewind, full production speed in the slitting and rewind operation may proceed, or if necessary the initial or start-up rewind may be discarded and the web strips started onto fresh cores in order to have all of the rewound rolls or drums of the desired square ends and substantially uniform tension.

It has been found that for some operations the spreader may be equipped with only the bar 17 which will serve to guide the strips in laterally spaced relation over the wrap area of the bar, with all of the advantages inherent in the incremental adjustments of the wrap area for which the bar 17 is equipped.

It will be understood that variations and modifications may be effected without departing from the spirit and scope of the novel concepts of this invention.

I claim as my invention:

1. A web spreader adapted to be operatively disposed between a slitter and other processing equipment, and comprising:

a first spreader bar adapted to have web strips run across a limited wrap area thereof;

said first spreader bar having a bowed relation to the web strips to spread them substantially fan-shape;

a second resiliently bendable spreader bar mounted adjacently downstream from the first bar and adapted to receive the web strips to run across a web strip wrap area of the second bar;

bow generating members mounting the opposite ends of said second bar, and means for adjusting said bow generating members for resiliently bending said second bar for effecting a primary bowed relation to the web strips for orienting the strips from the fan spread relation effected by said first bar into substantially parallel running relation;

and means for selectively effecting secondary adjustments of the web strip wrap area of the second bar incrementally at any of a plurality of respective limited areas along its length without altering said primary bowed relation whereby to compensate for variations in web thickness, bulk or length where any of these conditions may appear in any of the web strips.

2. A web spreader according to claim 1, wherein each of the spreader bars is resiliently bendable, and bow generating members mounting the opposite ends of each of said bars and means for adjusting said bow generating members mounting each of said bars for effecting selective resilient bending bowing adjustment of the bars.

3. A spreader according to claim 1, wherein each of the bars is secured at its opposite ends to respective bow generating lever members, fulcrum means mounting said lever members, and said means for adjusting adapted to actuate said lever members relative to the fulcrum means for effecting bending bow adjustments of the respective spreader bars.

4. A spreader according to claim 3, including means mounting the fulcrum means and the lever members for effecting simultaneous adjustments in the positions of the spreader bars relative to the path of web strips to be spread by the spreader bars.

5. A spreader according to claim 1, including means mounting the spreader bars for simultaneous positional adjustment relative to the path of travel of web strips through the spreader.

6. A web spreader according to claim 1, wherein said means for selectively effecting adjustments of the web strip wrap area are operable to effect selective incremental secondary adjustments while the web spreader is in operation with web strips running across the web strip area of the second bar.

7. A web spreader adapted to be operatively disposed between a slitter and other processing equipment, and comprising:

a first spreader bar adapted to have web strips run across a limited wrap area thereof;

said first spreader bar having a bowed relation to the web strips to spread them substantially fan-shape;

a second spreader bar mounted adjacently downstream from the first bar and adapted to receive the web strips to run across a web strip wrap area of the second bar;

said second bar having a primary bowed relation to the web strips for orienting the strips from the fan spread relation effected by said first bar into substantially parallel running relation;

and means for selectively effecting secondary adjustments of the web strip wrap area of the second bar incrementally along its length without altering said primary bowed relation whereby to compensate for variations in web thickness, bulk or length;

said web strip wrap area of said second bar comprising a saddle member mounted on said second bar and having means for effecting said secondary adjustments attached thereto.

8. A spreader according to claim 7, including means for supplying web strip flotation air to the wrap area surface of said saddle member.

9. A spreader according to claim 7, wherein said means for effecting adjustments comprise blocks attached to the saddle member and extending into the second spreader bar through means acting on the blocks for causing the saddle member to conform substantially to the bow curvature of said second spreader bar, and means accessible exteriorly of the second spreader bar for effecting selective adjustments of said blocks and thereby selectively adjusting the bow curvature of the saddle member relative to said second spreader bar.

10. A spreader according to claim 9, wherein said means accessible externally of the second spreader bar comprise rotary hand wheels located at spaced intervals along said second bar.

11. A method of operating a two bar spreader wherein each of the bars has a respective limited wrap area longitudinally therealong and across which web strips running between a slitter and other processing equipment are caused to travel in passing through the spreader, and comprising:

providing one of said spreader bars with a bowed relation to the web strips and effecting spreading of the web strips substantially fan-shape in travelling across the limited wrap area of said one spreader bar;

the other of said spreader bars being of resiliently bendable structure, and mounting the opposite ends of said other of said spreader bars on bow generating members;

adjusting said bow generating members and thereby bending said other of said spreader bars and providing a primary bowed relation of the other of said spreader bars to the web strips and effecting orientation of the strips from the fan spread relation into substantially parallel running relation in travelling across the limited wrap area of said other bar;

and selectively effecting secondary adjustments of the web strip wrap area of said other bar incrementally at any of a plurality of respective limited areas along its length without altering said primary bowed relation and thereby compensating for variations in web thickness, bulk or length where any of these conditions may appear in any of the web strips.

12. A method according to claim 11, comprising adjusting bow generating lever members secured to opposite ends of both of said spreader bars and thereby resiliently bending the bars to provide the bowed relation thereof to the web strips.

13. A method according to claim 11, comprising simultaneously adjusting the positions of said spreader bars relative to the path of web strips running through the spreader.

14. A method according to claim 11, comprising initially adjusting each of said spreader bars for its respective bowed relation to the web strips, immediately after slitting threading the web strips over said limited wrap areas, placing the leading end portions of the strips in control of the other processing equipment, commencing processing the strips, detecting any uneven tension in the strips resulting from variations in web thickness, bulk or length, and effecting said secondary adjustments of the web strip area of said spreader bar to compensate for the variations and thereby attaining substantially uniform tension in all of the strips during travel across said bars.

15. A method according to claim 11, comprising effecting said incremental secondary adjustments along said other bar while the web spreader is in operation with the web strips travelling through the spreader.

16. A method of operating a two bar spreader wherein each of the bars has a respective limited wrap area longitudinally therealong and across which web strips running between a slitter and other processing equipment are caused to travel in passing through the spreader, and comprising:

providing one of said spreader bars with a bowed relation to the web strips and effecting spreading of the web strips substantially fan-shape in travelling across the limited wrap area of said one spreader bar;

providing a primary bowed relation of the other of said spreader bars to the web strips and effecting orientation of the strips from the fan spread relation into substantially parallel running relation in travelling across the limited wrap area of said other bar;

selectively effecting secondary adjustments of the web strip wrap area of said other bar incrementally along its length without altering said primary bowed relation and thereby compensating for variations in web thickness, bulk or length;

and adjusting a saddle member mounted on said other of said bars and providing its limited wrap area, and thereby effecting adjustment to compensate for variations in web thickness, bulk or length.

17. A method according to claim 16, comprising providing flotation air to the wrap area surface of said saddle member.

18. A web spreader adapted to be operatively disposed between a slitter and other processing equipment, and comprising:

a spreader bar adapted to have web strips run across a limited wrap area thereof;

bow generating members mounting the opposite ends of said spreader bar, and means for adjusting said bow generating members for resiliently bending said spreader bar and effecting a primary bowed relation to the web strips so that the strips will be guided in laterally spaced relation over said wrap area of said bar;

and means for selectively effecting secondary adjustments of the web strip wrap area of said spreader bar incrementally at any of a plurality of respective limited areas along its length without altering said primary bowed relation whereby to compensate for variations in web thickness, bulk or length where any of these conditions may appear in any of the web strips.

19. A web spreader adapted to be operatively disposed between a slitter and other processing equipment, and comprising:

a spreader bar adapted to have web strips run across a limited wrap area thereof;

said spreader bar having a primary bowed relation to the web strips so that the strips will be guided in laterally spaced relation over said wrap area of said bar;

and means for selectively effecting secondary adjustments of the web strip wrap area of said spreader bar incrementally along its length without altering said primary bowed relation whereby to compensate for variations in web thickness, bulk or length;

said web strip wrap area of said spreader bar comprising a saddle member mounted on said spreader bar and having said means for effecting adjustments attached thereto.

20. A web spreader according to claim 19, wherein said spreader bar is hollow, said means for effecting adjustments extend from within said hollow bar to said saddle member, and means for supplying web strip flotation air to the wrap area surface of said saddle member from within said bar through said means for effecting adjustments.

21. A method of operating a spreader wherein a spreader bar has a respective limited wrap area longitudinally therealong and across which web strips running between a slitter and other processing equipment are caused to travel in passing through the spreader, and comprising:

said spreader bar being of resiliently bendable structure, and mounting the opposite ends of said spreader bar on bow generating members;

adjusting said bow generating members and thereby bending said spreader bar and providing said spreader bar with a primary bowed relation to the web strips and guiding the web strips in spread relation in travelling across the limited wrap area of said spreader bar;

and selectively effecting secondary adjustments of the web strip wrap area of said spreader bar incrementally at any of a plurality of respective limited areas along its length without altering said primary bowed relation and thereby compensating for variations in web thickness, bulk or length where any of these conditions may appear in any of the web strips.

22. A method of operating a spreader wherein a spreader bar has a respective limited wrap area longitudinally therealong and across which web strips running between a slitter and other processing equipment are caused to travel in passing through the spreader, and comprising:

providing said spreader bar with a primary bowed relation to the web strips and guiding the web strips in spread relation in travelling across the limited wrap area of said spreader bar;

and selectively effecting secondary adjustments of the limited wrap area of said spreader bar incrementally along its length without altering said primary bowed relation by adjusting a saddle member mounted on said spreader bar and providing said limited wrap area, and thereby effecting adjustment to compensate for variations in web thickness, bulk or length.

23. A method according to claim 22, wherein said spreader bar is hollow and has means for effecting said asjustments extending from within the bar to the saddle member, and comprising providing flotation air to the wrap area surface of said saddle member from within said hollow bar through said means for effecting adjustments.

24. A web strip orienter adapted to be operatively disposed between a web strip source and other equipment, and comprising:

a hollow bar adapted to have web strips run across a limited wrap area thereof;

said bar having a primary bowed relation to the web strips, so that the strips will be guided in laterally oriented relation over said wrap area of said bar;

a saddle member mounted on said bar and providing said web strip wrap area of said bar;

means within said hollow bar for selectively effecting secondary adjustments of said saddle member incrementally along its length without altering said primary bowed relation of said bar, whereby to compensate for variations in web thickness, bulk or length;

and means for supplying web strip flotation air to the wrap area surface of said saddle member from within said bar through said means for effecting adjustments.

25. A web strip orienter according to claim 24, wherein said means within said hollow bar comprise adjustment bar means having air passage means therein, and ports leading from said air passage means to said web strip wrap area surface of said saddle member.

26. A method of operating a web strip orienter, wherein a hollow bar has a limited wrap area longitudinally therealong and across which web strips running between a web strip source and other equipment are caused to travel in passing through the orienter, and comprising:

providing said bar with a primary bowed relation to the web strips and guiding the web strips in laterally oriented relation in travelling across the limited wrap area of said bar;

selectively effecting secondary adjustments of the limited wrap area of said bar incrementally along its length, without altering said primary bowed relation, by adjusting a saddle member mounted on said bar and providing said limited wrap area, and thereby effecting adjustment to compensate for variations in web thickness, bulk or length;

and providing flotation air to the wrap area surface of said saddle member from within said hollow bar through means within the hollow bar by which adjusting of said saddle member is effected.

27. A method according to claim 26, wherein said means within said hollow bar by which adjusting of the saddle member is effected comprise adjustment bar structure, and directing said flotation air through passage means in said adjustment bar structure and through ports from the passage means to said wrap area surface of said saddle member.

28. A web strip orienter adapted to be operatively disposed between a source of web strips and other equipment, and comprising:

a resiliently bendable strip orienting bar adapted to have web strips run in side-by-side relation across a limited wrap area thereof;

bow generating members comprising respective lever plates supporting the opposite ends of said bar and having couplings mounting the ends of the bars to said plates;

fulcrum means mounting said lever plates rockably;

and means separate and spaced from said fulcrum means for adjusting said bow generating lever plates rockably about said fulcrum means for thereby effecting resilient bending of said bar to provide a bow in the bar for predetermined lateral orienting of the strips relative to one another.

29. A method of operating a web strip orienter wherein a resiliently bendable bar has a limited wrap area longitudinally therealong and across which web strips running between a source of web strips and other equipment are caused to travel in passing through the strip orienter, the method comprising:

supporting opposite ends of said bar on respective bow generating lever plate members;

mounting said lever plate members rockably on respective fulcrums;

and operating means separate and spaced from said fulcrum and thus adjusting said bow generating lever plate members rockably about said fulcrums and thereby effecting resilient bending of said bar to provide a predetermined bow in said limited wrap area.

* * * * *

UNITED STATES PATENT AND TRADEMARK OFFICE

CERTIFICATE OF CORRECTION

PATENT NO. : 4,239,141

DATED : December 16, 1980

INVENTOR(S) : Kenneth G. Frye

It is certified that error appears in the above—identified patent and that said Letters Patent is hereby corrected as shown below:

Figures 1-4 should be added as shown on the attached sheets. One the title page, Figure 2 should appear as the descriptive Fig. On the title page, "29 Claims, No Drawings" should read --- 29 Claims, 4 Drawing Figures --.

Column 8, line 40, for "said spreader" read -- said other spreader --.

Column 10, line 29, for "asjustments" read -- adjustments --.

Signed and Sealed this

*Nineteenth* Day of *May 1981*

[SEAL]

*Attest:*

RENE D. TEGTMEYER

*Attesting Officer*

*Acting Commissioner of Patents and Trademarks*

Fig. 1
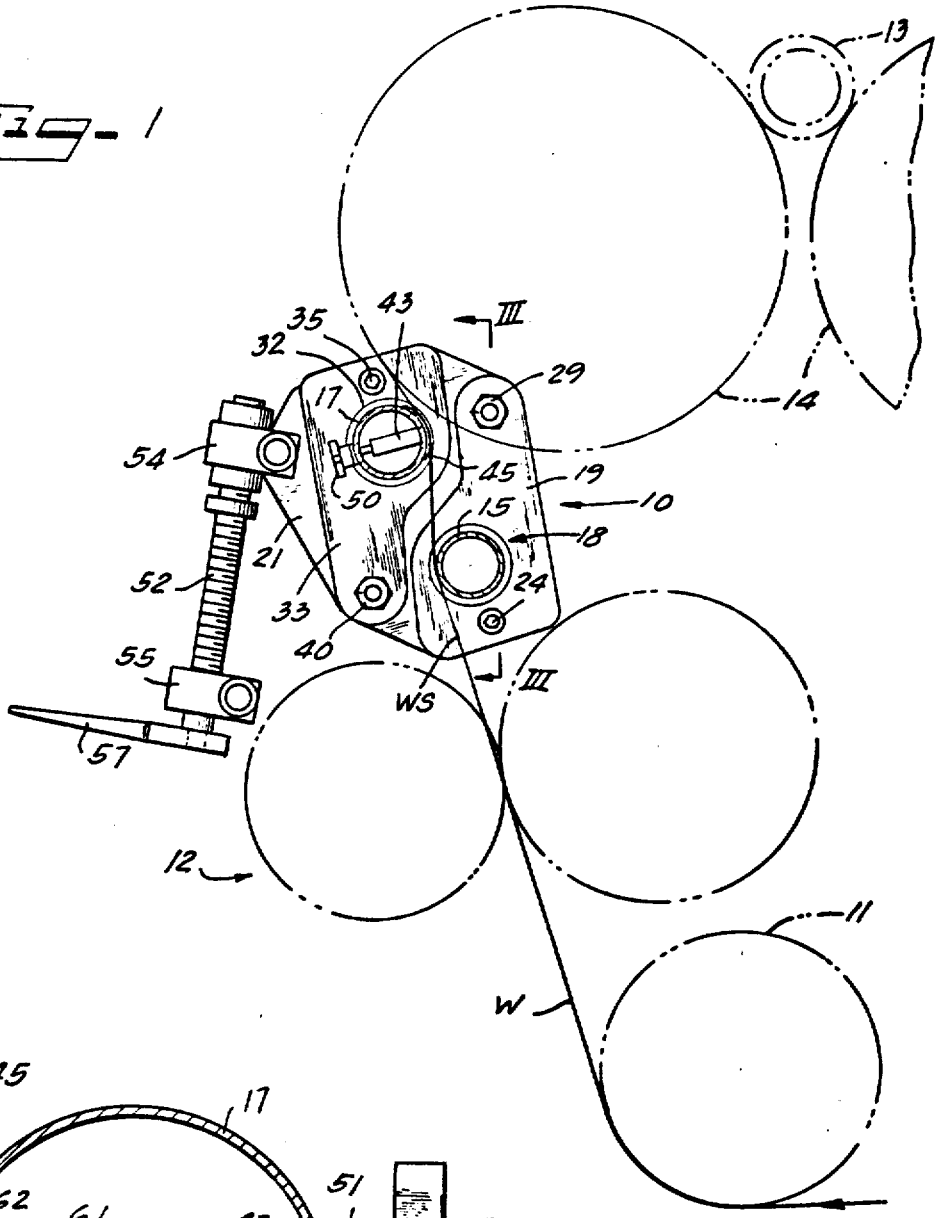
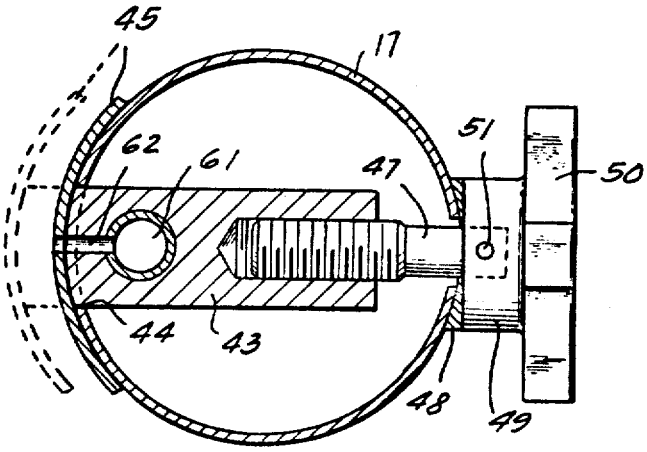
Fig. 4